US007547257B1

(12) United States Patent
Shah

(10) Patent No.: US 7,547,257 B1
(45) Date of Patent: Jun. 16, 2009

(54) STACK AND TILT FOOTWORK AND BODY PIVOT TRAINING AID

(76) Inventor: Sarmad A. Shah, 10602 Timberwood Cir., Suite 3, Louisville, KY (US) 40223

( * ) Notice: Subject to any disclaimer, the term of this patent is extended or adjusted under 35 U.S.C. 154(b) by 0 days.

(21) Appl. No.: 12/028,264

(22) Filed: Feb. 8, 2008

Related U.S. Application Data

(60) Provisional application No. 60/955,495, filed on Aug. 13, 2007.

(51) Int. Cl.
*A63B 69/36* (2006.01)

(52) U.S. Cl. ..... 473/218; 473/270; 473/277

(58) Field of Classification Search ..... 473/207, 473/217, 218, 266, 269, 270, 271, 273, 277
See application file for complete search history.

(56) References Cited

U.S. PATENT DOCUMENTS

| | | | | |
|---|---|---|---|---|
| 2,847,769 | A | 8/1958 | Schlesinger | |
| 3,195,891 | A * | 7/1965 | Rogers | 473/217 |
| 3,218,734 | A | 11/1965 | O'Brien | |
| 3,363,903 | A * | 1/1968 | O'Brien | 473/273 |
| 3,866,339 | A | 2/1975 | Latto | |
| 3,951,407 | A | 4/1976 | Calacurcio | |
| 4,073,075 | A | 2/1978 | O'Brien | |
| 4,081,918 | A | 4/1978 | O'Brien | |
| 4,118,034 | A | 10/1978 | O'Brien | |
| 4,145,055 | A | 3/1979 | O'Brien | |
| 4,147,356 | A * | 4/1979 | Brandell | 473/271 |
| 4,819,940 | A | 4/1989 | Davis | |
| 4,866,861 | A | 9/1989 | Noone | |
| 4,875,683 | A | 10/1989 | Wellman et al. | |
| 5,197,739 | A * | 3/1993 | Johnson, III | 473/271 |
| 5,212,894 | A | 5/1993 | Paparo | |
| 5,263,863 | A * | 11/1993 | Stefani et al. | 473/269 |
| 5,288,074 | A * | 2/1994 | Scheurer | 473/277 |
| D352,756 | S * | 11/1994 | Giantonio | D21/791 |
| 5,445,384 | A | 8/1995 | Yancey | |
| 5,487,546 | A | 1/1996 | Yasuda | |
| 5,762,565 | A * | 6/1998 | Milam et al. | 473/271 |
| 5,916,037 | A * | 6/1999 | Hill | 473/277 |

* cited by examiner

*Primary Examiner*—Nini Legesse
(74) *Attorney, Agent, or Firm*—James Cole; Middleton & Reutlinger

(57) ABSTRACT

A golf training device comprises a wedge shaped body for receiving a user's foot, a guide rod system connected to the wedge shaped body comprising a base portion, an adjustable collar disposed in the base portion and, a guide rod extending from the adjustable collar toward a users hip.

16 Claims, 5 Drawing Sheets

STACK AND TILT FOOTWORK AND BODY PIVOT TRAINING AID

CROSS REFERENCES TO RELATED APPLICATIONS

This application under 35 USC § 119(e) claims priority to, and benefit from, U.S. Provisional Application Ser. No. 60/955,495, filed on Aug. 13, 2007, which is currently pending.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates to golf training aid, and more specifically to a golf training aid to develop muscle memory and correct golf pivot action commensurate with a stack-and-tilt golf swing.

2. Description of the Related Art

It is widely recognized in the play of golf that in order to generate power and consistency a player must correctly pivot, which according to one teaching method requires correct "stacking" of the upper body against the lower body at the top of the golf swing, and unwinding of the torso against the lower body. Alternatively stated, a player must have a proper relationship between movement of the upper body and lower body which requires a clear understanding of the relationship between the torso and the legs. A good relationship between legs and torso provides a steady center of gravity as the torso winds and unwinds around the pivoting point resulting in power and consistency in the golf swing.

Better golfers create proper angles at address, top of the backswing and at the point of impact. If the body moves correctly, the player creates an increased amount of speed at impact, resulting in longer shots and better ball striking. One type of motion known to create additional speed and proper motion is known as stack-and-tilt golf swing. The stack-and-tilt swing golf swing involves creating proper position of the head, right knee, right leg and hip and feel of tension and pulling of the inner right thigh muscles (for right handed golfer) against the upper torso and weight transfer around the sternum (center of the chest) and tailbone during the take-away, back swing, downswing, at impact and follow-through.

It is preferable to provide a novel training aid to provide golfers with an apparatus to achieve improved pivot, footwork and relationship between the torso and the legs according to stack-and-tilt principles.

SUMMARY OF THE INVENTION

With regard to the foregoing, one embodiment of the invention eliminates the oversights, difficulties, and disadvantages of the prior art by providing a golf training aid which teaches correct positioning for the stack-and-tilt golf swing.

A golf training device comprises a wedge shaped body for receiving a user's foot, a guide rod system connected to the wedge shaped body comprising a base portion, an adjustable collar disposed in the base portion and, a guide rod extending from the adjustable collar toward a users hip. The golf training device wherein the wedge forces weight to the inside of the user's foot. The golf training device wherein the adjustable collar is moveable about a pivot point to vary an angle of the guide rod. The adjustable collar being tightenable to retain the guide rod in a desired location. The golf training device guide rod formed of a plurality of rod elements. The golf training device further comprises at least one strap connected to the body for receiving the user's foot.

A golf training device for a stack-and-tilt golf swing comprises a body having a wedge shape with a high side and a low side, and an inside of the body being the low side and an outside of the body being a high side, a guide rod system comprising a base portion connected to the body, a pivotable collar disposed in the base portion, the pivotable collar adjustable through a preselected arcuate distance, a guide rod received by the pivotable collar and movable with the pivotable collar through the preselected arcuate distance. The golf training device further comprising first strap near a forward portion of the body, and a second strap near a rear portion of the body. The golf training device further comprising a tightening mechanism. The golf training device wherein the body is a molded device. The golf training device wherein the body and the base portion are integrally molded. The golf training device wherein one of the body and the base portion has an insert, and the other of the base portion and the body has a cavity. The golf training device further comprising cleats depending from the body. The golf training device the cleats being soft-spikes. The golf training device wherein the cleats are formed integrally with the body. The golf training device wherein the cleats are removable from the body.

DETAILED DESCRIPTION

Figure 1:
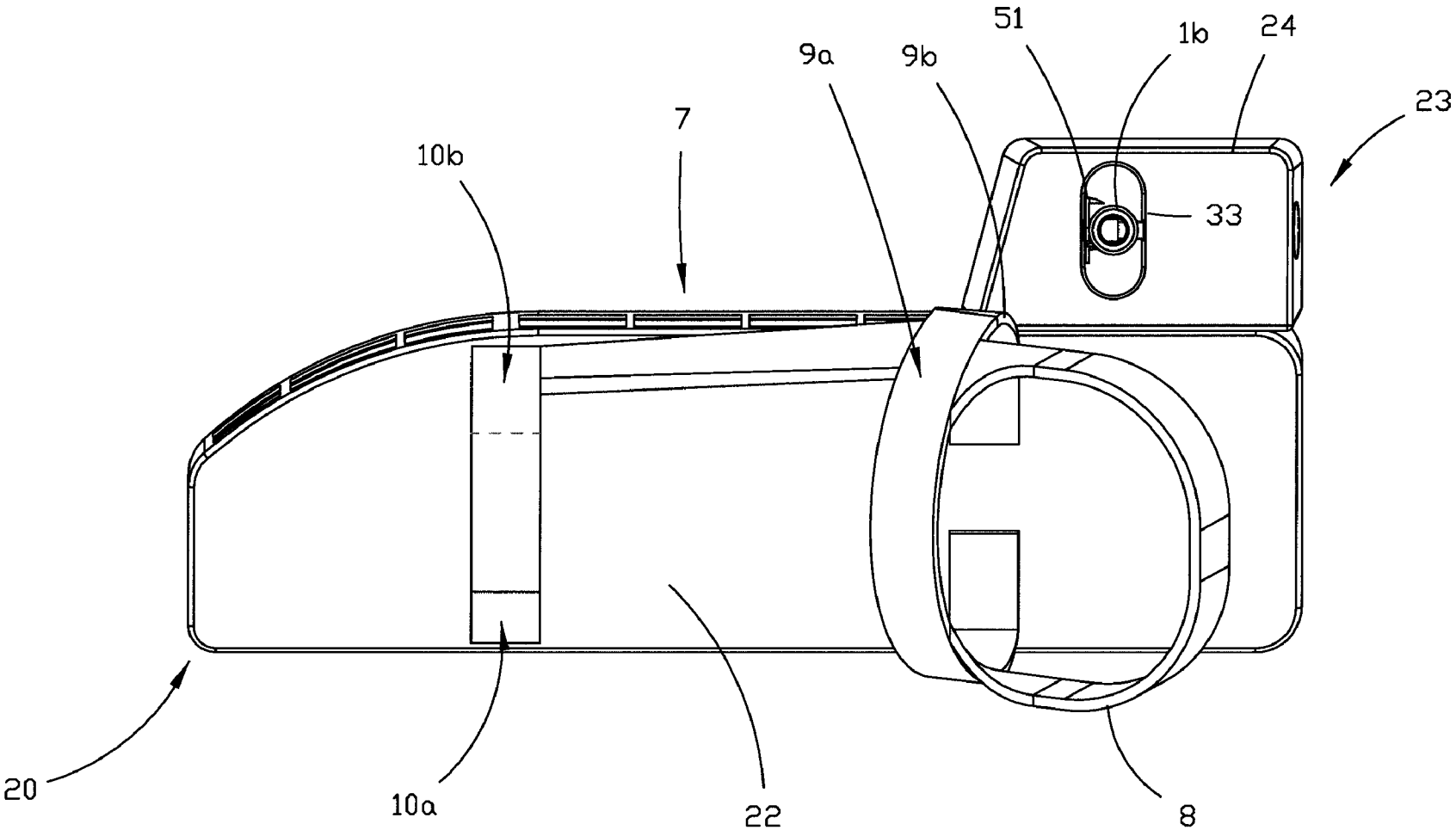
FIG. 1 depicts a top view of a portion of an exemplary golfer training aid.

The following description and drawings illustrate embodiments of the invention sufficiently to enable those skilled in the art to practice it. It is to be understood that the invention is not limited in its application to the details of construction and the arrangement of components set forth in the following description or illustrated in the drawings. The invention is capable of other embodiments and of being practiced or of being carried out in various ways. For example, other embodiments may incorporate structural, chronological, electrical, process, and other changes. Examples merely typify possible variations. Individual components and functions are optional unless explicitly required, and the sequence of operations may vary. Portions and features of some embodiments may be included in or substituted for those of others. The scope of the invention encompasses the appended claims and all available equivalents. The following description is, therefore, not to be taken in a limited sense, and the scope of the present invention as defined by the appended claims.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, and as described in subsequent paragraphs, the specific mechanical configurations illustrated in the drawings are intended to exemplify embodiments of the invention and that other alternative mechanical configurations are possible.

The exemplary embodiments described herein provide a golf training aid which teaches proper interaction between the lower body and the upper body while also placing other body angles in better position according to the stack-and-tilt method of hitting a golf shot. Referring now in detail to the drawings, wherein like numerals indicate like elements throughout the several views, there is shown in FIGS. 1 through 6 various aspects of the golf training aid.

Referring initially to FIG. 1, a golf training aid 20 is depicted in top view. The training aid 20 comprises a body 22 for receiving a user's foot and which is generally wedge-shaped having a higher end near the outer side of a user's foot and a lower end along the inside of the user's foot. The wedge shape of the body 22 forces the user's weight to be supported along the inside of the user's foot which is one of the principals of the stack-and-tilt method of golfing. The body 22 further comprises at least one forward strap 10*a*, 10*b* which is positioned forwardly of the instep and another at least one shoe strap 9*a*,9*b* which is secured to the body of the device and extends outwardly over user's shoe. A third strap 8 extends from the at least one strap 9*a*,9*b* and behind the shoe and holds the two straps 9*a*,9*b* together providing added stability and preventing the user's shoe from sliding. The straps 8, 9*a*, 9*b*, 10*a*, 10*b* may be embedded in the body 22 during the formation of the body 22 by conventional molding techniques or alternatively may be fastened to the body 22 by fasteners embedded in the body 22 during molding. The straps 9, 10 extend from either side of the body and can be wrapped upwardly over the top of the shoe and tightened while strap 8 wraps around the rear of the shoe. The strap portions designated 9*a* and 10*a* are preferably formed with hook and loop fasteners, generally known as (VELCRO) on a top, exposed surface, and the opposite strap ends designated 9*b* and 10*b* have hook and loop fasteners facing the fasteners of straps 9*a* and 10*a*. The strap portions 9*a* and 10*a* are pulled tight over the top of the shoe thereby overlapping different areas of the shoe to provide adjustability for users of different foot sizes. A connecting strap 7 extends from the forward strap 10 to rear strap 9 providing some level of connectivity between the two straps 8, 9, 10.

The training aid 20 further comprises a hip movement guide rod system 23. The guide rod system 23 is attached to the body 22 device by means of two plates and a screw 50, although various connection mechanisms may be utilized. The body 22 receives a user's foot or shoe and disposes the user's weight along the inside of the user's foot while the guide rod system 23 provides feedback to the user with regard to lateral movement of the hips during the golf swing. Specifically, the adjustable guide rod system 23 provides feedback to the user by touching the user's hip or leg when the user sways too much during a stack-and-tilt golf swing.

Figure 2:
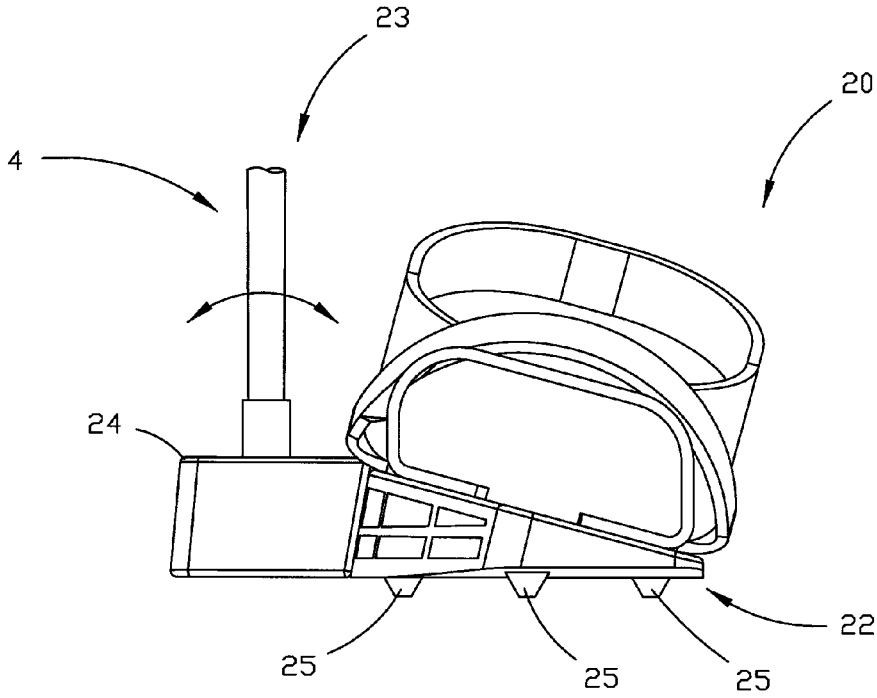
FIG. 2 depicts a front view of the training aid of FIG. 1.

Referring now to FIG. 2, a front view of the golf training aid 20 is depicted. The body 22 receives a user's right foot, which is rear foot for a right handed player. The body 22 is wedge shaped having a higher side along the outer side of the foot and a low side along the inner side of the foot. Upon strapping a foot or shoe to the body 22, the user's weight is forced along the inner side of the foot and provides muscle memory to a user on how the weight positioning should feel during a stack-and-tilt methodology of golfing.

The guide rod system 23 is shown with a rod assembly 4 inserted. The system 23 comprises a rod assembly 4 is connected to the base portion 24. The rod assembly 4 is pivotally connected to the base portion 24 to define the guide rod system 23. The guide rod assembly 4 is pivotable through a preselected arc in order to move toward and away from the user's hip. The rod assembly 4 may be positioned at multiple locations prior to tightening at the selected position. The rod assembly 4 is movable toward and away from the user's hip about an axis extending into the base portion 24.

Figure 3:
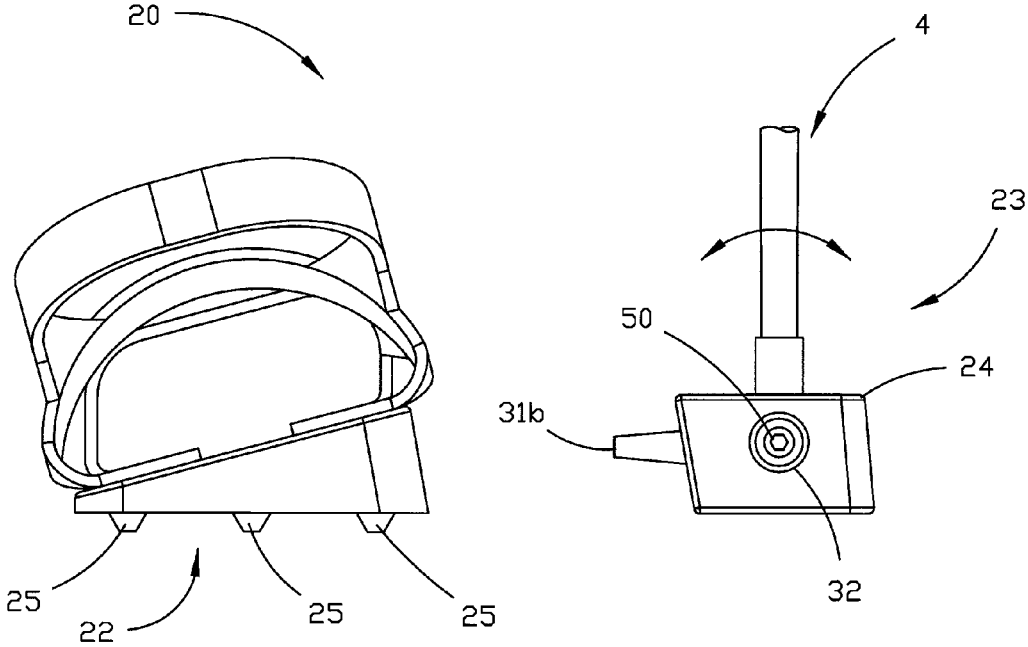
FIG. 3 depicts a partially exploded rear view of the training aid of FIG. 1.

Referring now to FIG. 3, a rear view of the training aid 20 is depicted. The guide rod system 23 is depicted removed from the body 22. The body 22 comprises an opening for receiving an insert 31*b* extending from the base portion 24 of the guide rod system 23. An opening in body 22 is large enough to receive and hold the 31*b* insert. During manufacture a fixative such as glue or cement may be utilized to retain the base portion 24 within the body 22. Alternatively, the insert 31*b* may extend from the body 22 and may be received by an opening in the base portion. As a further alternative, the parts may be fastened together mechanically or the body 22 and the base portion 24 may be integrally formed as a single molded element.

Depending from a lower surface of the body are a plurality of cleats 25. The cleats 25 may be integrally molded into the body 22 or may be removably connected. For example, the cleats 25 may be embodied by hard spikes or soft spikes which are both twistably removable for installation.

The base portion 24 further comprises a fastener aperture or opening 32 through which a fastener is positioned for pivotal movement of the guide rod assembly 4. The base portion 24 also comprises a pivot aperture 33 located in an upper surface which allows for the arcuate motion of the guide rod assembly 4. The pivot aperture 33 is oval in shape to allow for movement of the assembly 4 through an arcuate motion. The apertures 32,33 (FIG. 1) open into a cavity within the base portion 24 and the cavity is partially shown from above in FIG. 1. A fastener 50 extends through the aperture 32 and into the cavity within the base portion 24 to provide the pivot axis for the assembly 4.

Figure 4:
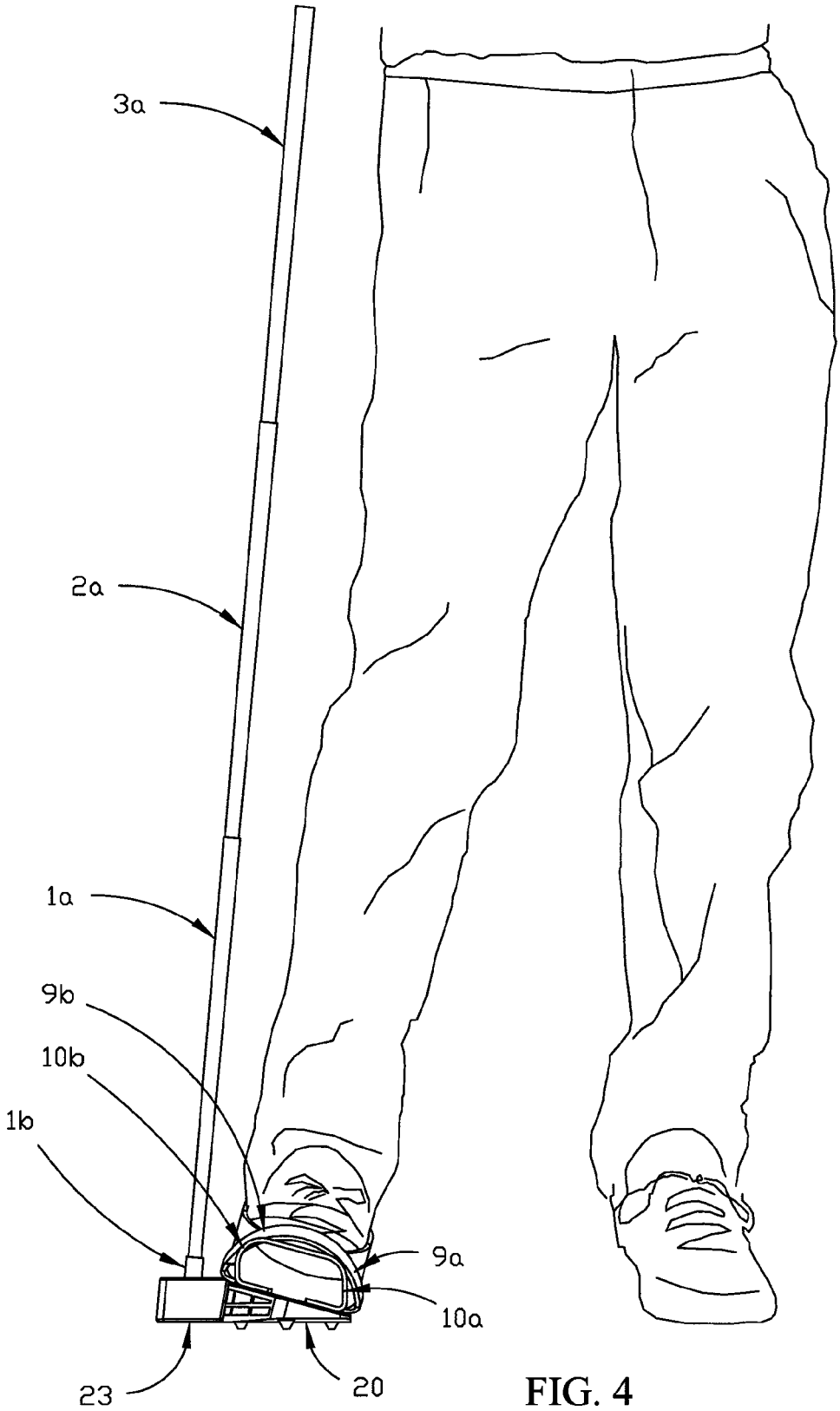
FIG. 4 depicts a front view of the training aid with a user's foot in position for use.

Referring to FIG. 4, a front view of the training aid 20 is depicted with a user shown in broken line utilizing the training aid 20. The user's right foot is positioned on the body 22 and attached thereto by the straps 8, 9, 10. The straps 8,9,10 provide stability and prevent the shoe from sliding. The guide rod assembly 4 is shown comprising a plurality of components. Within the opening 23 of base portion 24 is a collar 1*b*. The collar 1*b* is pivotally mounted on the fastener 50 extending through fastener aperture 32 of the base portion 24. As shown in FIG. 1, the collar 1*b* is movable through the pivot aperture 33, so as to adjust the position of the rod assembly 4 relative to the user's hip.

The collar 1*b* receives the guide rod assembly 4 to provide connection between the guide rod assembly 4 and the base portion 24 and thereby define the guide rod system 23. The guide rod assembly 4 comprises a plurality of rod segments or elements which may be disconnected for easy transport and reassembled at different practice locations. However, the plurality of rod elements may alternatively be a single rod of a longer length than any of the single rod elements shown in the exemplary embodiment. The exemplary guide rod assembly 4 is formed of a three-piece construction. A lowermost rod 1*a* is received by the collar 1*b*. The lowermost rod portion 1*a* is at least partially hollow and sized of a diameter capable of positioning within the collar 1*b*. A middle rod portion 2*a* is at least partially hollow and is positioned within the upper end of the rod 1*a* to connect the lowermost rod portion 1*a* and the middle rod portion 2*a*. An upper rod portion 3*a* is positioned with the upper hollow portion of middle rod portion 2*a*. The three rod portions 1*a*, 2*a* and 3*a* define the rod assembly 4. In the exemplary embodiment, friction may be utilized to maintain connection between the rod portions 1*a*, 2*a*, and 3*a*. In one alternative, the rod assembly 4 may be defined by a telescoping or nested rod system which is collapsible for easy storage and transport. Various means may be utilized to connected the rod portions. For example, fasteners or other connectors may alternatively be utilized. According to another exemplary embodiment, the middle rod portion may have a dowel at a lower end and the upper rod portion 3*a* may also have a dowel at a lower end. Each of the dowels would fit into the upper end of the rods 1*a* and 2*a* to form the rod assembly 4 As a result, the rod assembly 4 extends from the base portion 24 to the hip area of the user and may be adjusted through an arcuate distance at various angles so as to touch or engage a user's hip during the golf swing if the user's hips sway too far during the swing. In the embodiment depicted, the guide rod system 23 is adjusted to a desired angle for the depicted user.

Figure 5:
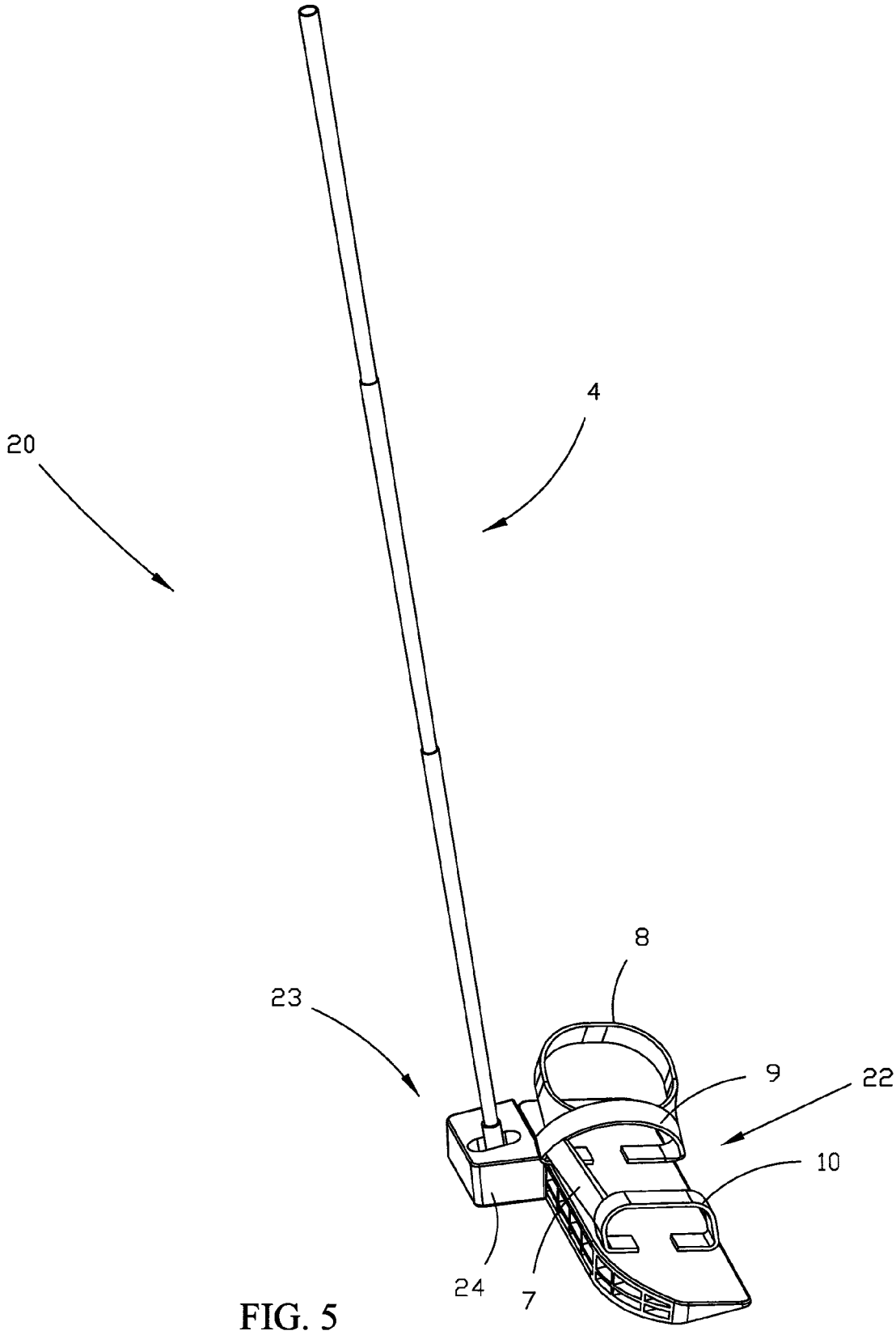
FIG. 5 depicts a perspective view of the golf training aid of FIG. 1; and, FIG. 6 depicts an exploded perspective view of the golf training aid of FIG. 4.
Figure 6:
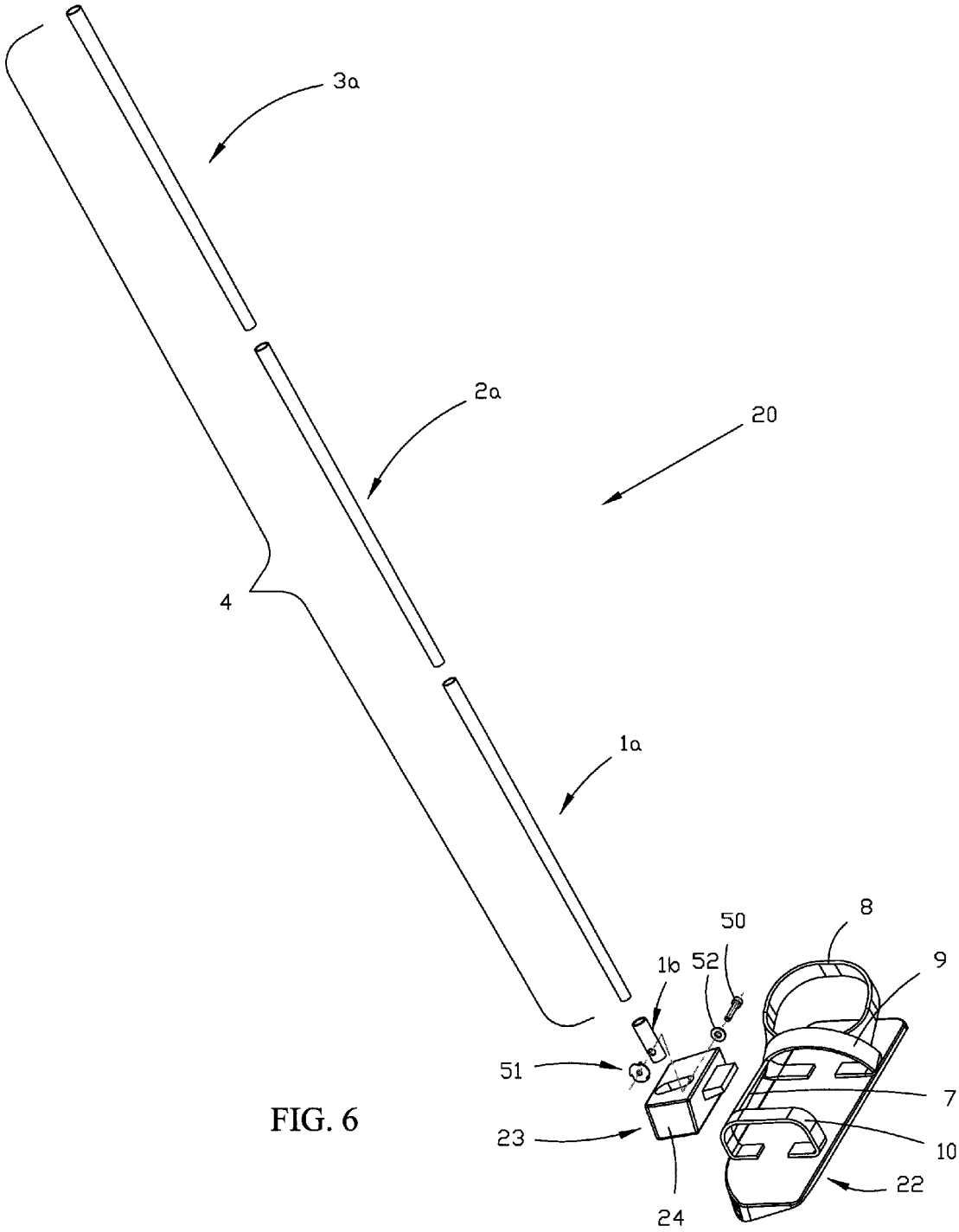

Referring now to FIGS. 5 and 6, the training aid 20 is shown in perspective view, one of which is an exploded perspective view. The golf training aid 20 comprises a body 22 and a guide rod system 23 connected to the body 22. The body 22 comprises straps 7, 8, 9, 10 providing a means of attaching the device 20 to a user's shoe or foot. The body 22 is shown to have a wedge shaped design forcing a user to place weight along the inside of the foot, which is a desirable characteristic of the stack-and-tilt golf swing.

The exploded view of FIG. 6 further depicts the fastener 50 extending through the base portion 24 of the guide rod system 23. The fastener 50 extends through a washer 52 into the base portion 24 of the guide rod system 23. The fastener 50 also extends through the collar 1*b* providing pivoting motion of the collar 1*b* and the guide rod assembly 4 connected to the collar 1*b*. A locking nut 51 on the opposite side of the collar 1*b* receives the fastener 50 and engages the collar 1*b* to tighten the collar 1*b* and guide rod assembly 4 at a desired angle for the user. Thus the rod assembly 4 may be tightened at various angles. Various tightening mechanisms may be utilized as will be understood by one skilled in the art.

It is apparent that variations may be made to the golf training aid in regards to specific design elements thereof. Such variations however are deemed to fall within the teachings of the present invention as generally modifications may be made to placement of the particular structure described herein or equivalents thereto while falling within the general teachings hereof.

I claim:

1. A golf training device, comprising:

a wearable wedge shaped body for receiving a user's trailing foot and restricting lateral movement of a user's hip;

a guide rod system connected to said wedge shaped body comprising:

a base portion connected to said wedge shaped body;

an adjustable collar disposed in said base portion; and, a guide rod extending upwardly from said adjustable collar toward said user's hip, said guide rod being pivotally adjustable with said collar toward or away from a user's hip said guide rod system indicating a swing error when said user's hip contacts said guide rod.

2. The golf training device of claim 1, said wedge forcing weight to the inside of said user's trailing foot.

3. The golf training device of claim 1, said adjustable collar moveable about a pivot point to vary an angle of said guide rod.

4. The golf training device of claim 1, said adjustable collar being tightenable inhibit pivoting and to retain said guide rod in a desired location.

5. The golf training device of claim 1, said guide rod formed of a plurality of rod elements.

6. The golf training device of claim 1 further comprising at least one strap connected to said body for receiving said user's trailing foot.

7. A golf training device for a stack-and-tilt golf swing comprising:

a body having a wedge shape with a high side and a low side, and an inside of said body being said low side and an outside of said body being said high side, said body receiving a user's trailing foot and restricting lateral movement of the user's hip;

a guide rod system comprising:

a base portion connected to said body;

a pivotable collar disposed in said base portion;

said pivotable collar adjustable through a preselected arcuate distance;

a guide rod being received by said pivotable collar extending upwardly from said collar and being movable with said pivotable collar through said preselected arcuate distance toward or away from a user's hip;

said guide rod system indicating excessive lateral movement during a golf swing when said user's hip contacts said guide rod.

8. The golf training device of claim 7 further comprising a first strap near a forward portion of said body, and a second strap near a rear portion of said body.

9. The golf training device of claim 7 further comprising a tightening mechanism.

10. The golf training device of claim 7, said body being a molded device.

11. The golf training device of claim 7, said body and said base portion being integrally molded.

12. The golf training device of claim 7 wherein one of said body and said base portion has an insert, and the other of said base portion and said body has a cavity.

13. The golf training device of claim 7 further comprising cleats depending from said body.

14. The golf training device of claim 13, said cleats being soft-spikes.

15. The golf training device of claim 13, said cleats being formed integrally with said body.

16. The golf training device of claim 13, said cleats being removable from said body.

* * * * *